US006182875B1

(12) United States Patent
Fareghi

(10) Patent No.: US 6,182,875 B1
(45) Date of Patent: Feb. 6, 2001

(54) ADJUSTABLE SKATE CARRIER

(76) Inventor: Deborah A. Fareghi, 2339 Vistoso Village Pl., Oro Valley, AZ (US) 85737

( * ) Notice: Under 35 U.S.C. 154(b), the term of this patent shall be extended for 0 days.

(21) Appl. No.: 09/394,472

(22) Filed: Sep. 11, 1999

Related U.S. Application Data

(60) Provisional application No. 60/099,774, filed on Sep. 10, 1998.

(51) Int. Cl.[7] ..... A45F 3/04
(52) U.S. Cl. ..... 224/259; 224/258; 224/264
(58) Field of Search ..... 224/258, 259, 224/264

(56) References Cited

U.S. PATENT DOCUMENTS

| | | | | |
|---|---|---|---|---|
| 3,326,432 | * | 6/1967 | Banks et al. | 224/258 X |
| 3,960,302 | * | 6/1976 | Mazzoni, Jr. | 224/250 X |
| 4,251,016 | * | 2/1981 | O'Rafferty et al. | 224/250 |
| 4,337,883 | * | 7/1982 | Pate | 224/250 |
| 4,790,460 | * | 12/1988 | Harper | 224/259 X |
| 4,856,689 | * | 8/1989 | Shore | 224/264 X |
| 5,092,506 | * | 3/1992 | Bolduc | 224/209 |
| 5,427,291 | * | 6/1995 | Smith | 224/250 |
| 5,603,545 | * | 2/1997 | Benson et al. | 224/250 X |
| 5,642,842 | * | 7/1997 | Taras | 224/250 |
| 5,718,363 | * | 2/1998 | Graves | 224/250 |
| 5,762,242 | * | 6/1998 | Yost | 224/250 |
| 5,853,213 | * | 12/1998 | Simpson | 294/158 |

FOREIGN PATENT DOCUMENTS

18254 * 8/1908 (GB) .

* cited by examiner

*Primary Examiner*—Stephen K. Cronin

(57) ABSTRACT

A simple and inexpensive apparatus for carrying skateboards and in-line skates. The invention can be adjusted to a variety of recreational equipment and can be easily folded for stowing in a pocket or pack when not in use.

2 Claims, 4 Drawing Sheets

Figure 1:
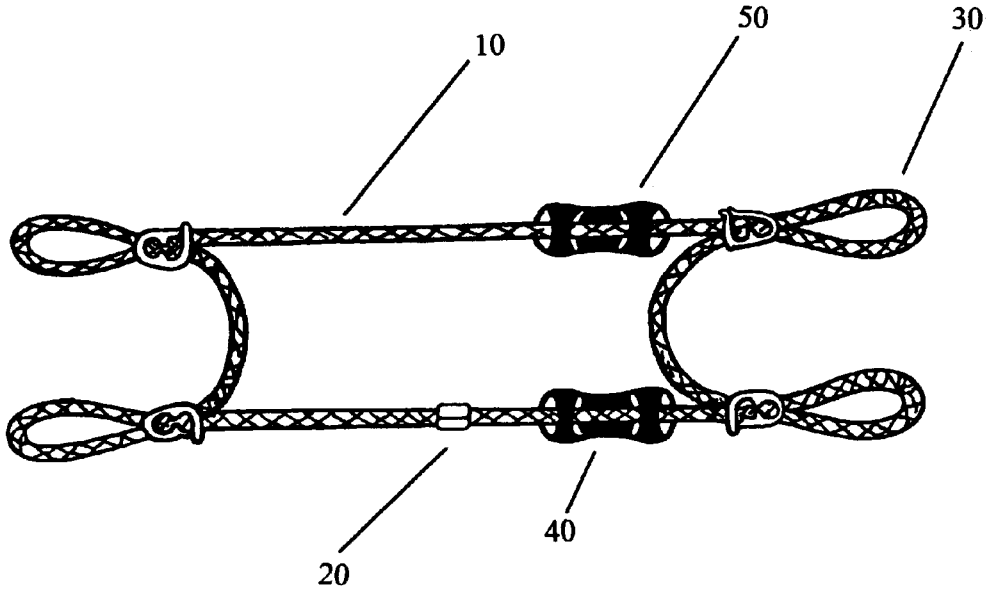

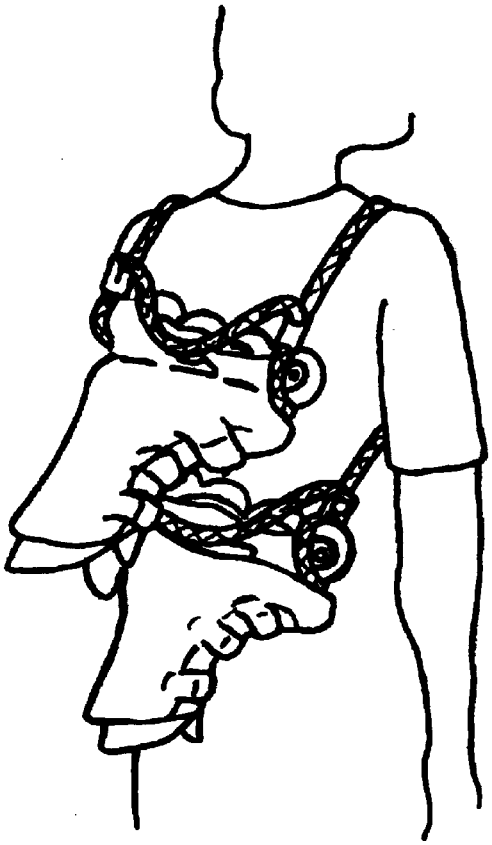
FIGURE 6
FIGURE 7
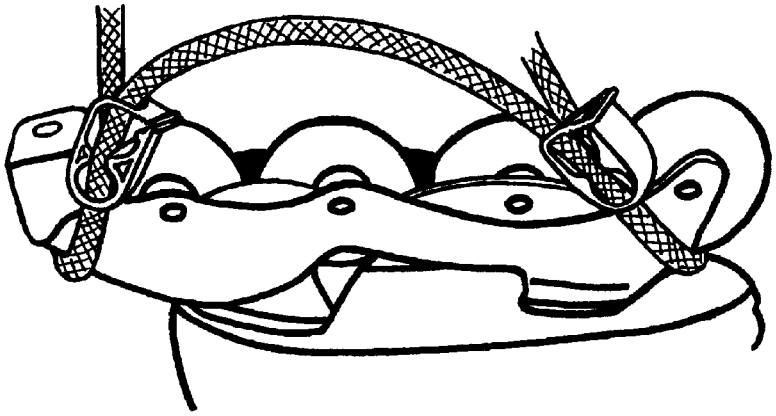

ADJUSTABLE SKATE CARRIER

RELATED APPLICATIONS

This application relates to a Provisional Application No. 60/099,774, filed on Sep. 10, 1998, by the same inventor.

BACKGROUND OF THE INVENTION

1. Field of the Invention

This present invention relates to devices for carrying objects, and more particularly adjustable, lightweight devices for carrying equipment for recreational activities such as skateboarding and in-line skating.

2. Description of the Prior Art

Carriers for large bulky objects such as skis dominate the field of carriers for recreational equipment. However, some of the carriers are also adaptable to carry skateboards and in-line skates.

One carrier for recreational equipment is disclosed in U.S. Pat. No. 3,960,302 (issued to Mazzoni). The ski carrying strap by Mazzoni. comprises a strap adapted to be loosely tied at either end to a pair of skis. Spaced strips of mutually engageable fastening material such as Velcro™ prevent the untying of the strap ends.

Another carrier is disclosed in U.S. Pat. No. 4,251,016, issued to O'Rafferty, et al. This carrier is designed to carry a stringed instrument and flexible harness comprises a fixed retaining member and adjustable straps which cross the top and body of the instrument. The harness is connected to an adjustable neck strap for carrying.

U.S. Pat. No. 5,427,291, issued to Smith, discloses a ski carrier comprising a strap with opposite end portions having overlapping ends formed into eyelets to form ski carrying loops. The strap is divided into two segments by a snapping fastener in the middle. Once the skis have been inserted into the carrier, the skis are carried by grasping the strap with a hand.

Another carrier is disclosed in U.S. Pat. No. 5,603,545, issued to Benson. This carrier is an adjustable length carrying strap which can be adapted to a wide variety of objects to assist the user in carrying the objects. Free-sliding connectors on either or both of the ends of the strap allows the carrier to be tightened around the object to be carried. Once the carrier is attached to the object the strap is placed over the shoulder for carrying.

U.S. Pat. No. 5,642,842, issued to Taras, discloses a carrier for carrying shoes and large boots, particularly in-line skates. The carrier comprises multiple adjustable straps to wrap around the recreational equipment to be carried and to allow the equipment to be carried by placing a strap around the waist or over the shoulder.

U.S. Pat. No. 5,718,363, issued to Graves discloses a carrier for firearms comprising an elongated adjustable strap, which allows the firearm to be carried around the waist or over the shoulder. A pair of shorter spaced-apart straps extends from the elongated carrying strap. These shorter straps adjust in length and encircle the firearm to secure it to the elongated strap.

U.S. Pat. No. 5,762,242 issued to Yost teaches a system for carrying skis and ski poles either by hand or over the shoulder. The carrier comprises an elongated strap assembly extended between fore and aft ski loops. An adjustment buckle allows the elongated strap to be shortened for carrying skis by hand or lengthened for carrying the skis over the shoulder.

Finally, U.S. Pat. No. 5,853,213 issue to Simpson discloses a carrier for in-line skates. The carrier comprises a flexible cord which connects to each of a pair of skates with disks located at each end of the cord. A handle assembly is coupled to the cord intermediate to the ends for carrying the skates to which the carrier is attached. The attached handle and disks would make the carrier difficult to stow in a small pocket or container.

Thus, a variety of carriers for recreational equipment are known. Several of the carriers are designed to be adjustable to carry various objects. Most of the carriers are designed to be portable, but they are too bulky to be easily stowed and carried when not in use.

Accordingly, it would be desirable to develop a carrier that offers at once the features of a carrier that is adjustable to accommodate recreational equipment of varying size and shape and to allow the equipment to be carried while at the same time allowing freedom of movement for the person carrying the equipment. It is desirable for such a carrier to be of such a design as to allow a person to carry and stow the carrier easily while the person is using the recreational equipment sought to be carried. Finally, the carrier should be capable of easy and inexpensive manufacture.

SUMMARY OF THE INVENTION

In view of the disadvantages inherent in the known devices for the carrying of recreational equipment, the present invention provides a simple and inexpensive carrier for recreational equipment such as skateboards and in-line skates. The carrier is lightweight and flexible enough so that the user can easily stow the carrier in a pocket or pack when the user is skating or walking. At the same time the fact that the design is simple and inexpensive, makes it potentially available to the growing numbers of recreational skaters.

The present invention attains this simplicity and ease of manufacture by using a cord such as a nylon or polypropylene rope to form the elongated cord of the invention. The ends of the cord are joined together using a simple connector. The cord is formed into a large loop somewhat rectangular in shape with rounded comers and having a width greater than height Four clamps such as are used in the medical field to adjust the flow of fluids through flexible tubing are installed at each of the four comers of the cord when formed into the semi-rectangular shape. As the cord is inserted through the clamps, four smaller loops are formed at each the four corners. When a person desires to carry a skateboard or other recreational equipment, he or she forms the smaller loops into the proper sizes to fit the loops over the wheels or trucks or other attach points on the recreational equipment. The loop is pulled tight around the attach point and the clamp locked in place on the cord. The whole apparatus with the skateboard or other recreational equipment is lifted up and the longer segments of the cord between the loops are pulled up and over the shoulders like a backpack. When a person is ready to use the skateboard or other recreational equipment, he or she loosens the four clamps, extends the smaller loops holding the equipment and is ready for recreation. The invention can be folded or wound up and stuffed in a pocket or pack.

BEST MODES FOR CARRYING OUT THE INVENTION

Figure 2:
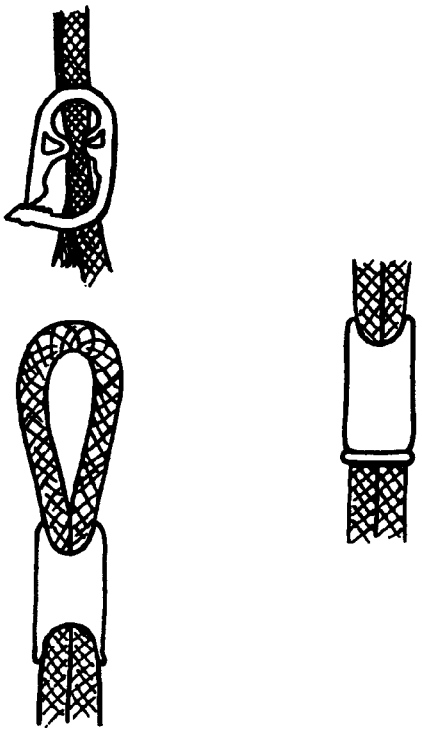
Figure 3:
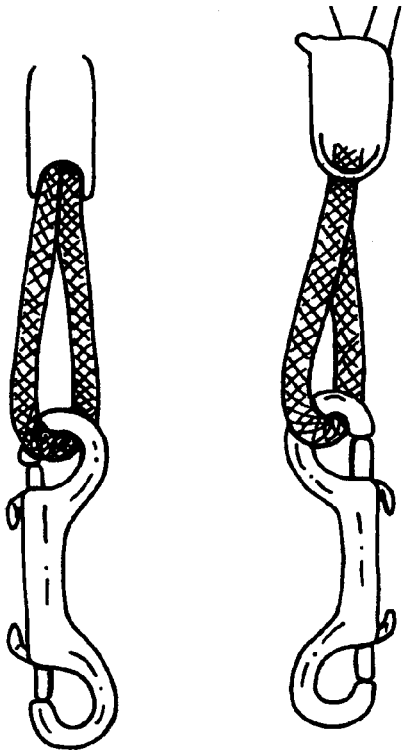
Figure 4:
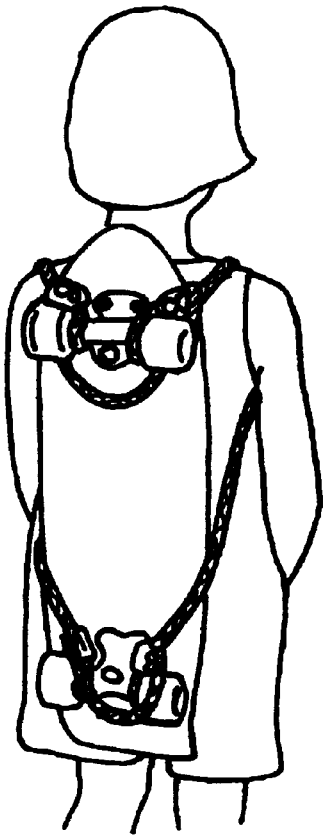
Figure 5:
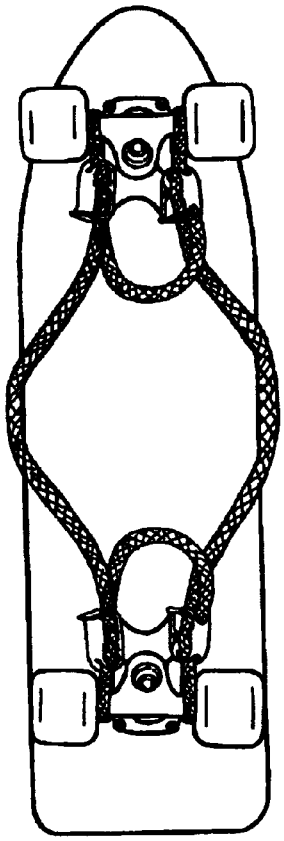

The preferred embodiment of the present invention can be best understood by reference to the drawings. FIG. 1 shows the invention when placed on a flat surface. The elongated flexible cord 10 has its two ends joined together by connector 20. Four smaller loops 30 are formed in flexible cord 10 and held in place by clamps 40. Shoulder pads 50 protect the shoulders of the person carrying the recreational equipment. FIG. 2 shows three expanded views of clamps 40. FIG. 3 shows the installation of standard connectors in the smaller loops to attach the invention to recreational equipment which has attach points FIG. 3 shows a person carrying a skateboard with the invention. FIG. 5 sows one method of installing the invention is installed on a skateboard. FIG. 6 shows a person carrying a pair of in-line skates with the invention. FIG. 7 shows a detail of one method of attaching the invention to an in-line skate.

What is claimed is:

1. An adjustable apparatus for carrying recreational equipment, said apparatus comprising:

an elongated flexible cord having a first end and a second end;

a connector device to join said first end and said second end together, whereby said flexible cord is formed into a continuous loop;

wherein a pair of smaller loops is formed in a first segment of said continuous loop and a second pair of smaller loops is formed in a second segment of said continuous loop, the size of said smaller loops and of said first and second segments being determined by the size and shape and attachment points of the recreational equipment being carried;

four clamping devices installed on said continuous loop in such a manner as to form said four smaller loops and to provide for adjustment of the size of said smaller loops.

2. The apparatus of claim 1, wherein a pair of shoulder pads are installed on said continuous loop intermediate between said two pairs of smaller loops.

* * * * *